US010907231B2

(12) United States Patent
Joo et al.

(10) Patent No.: US 10,907,231 B2
(45) **Date of Patent: *Feb. 2, 2021**

(54) GRAIN-ORIENTED ELECTRICAL STEEL SHEET AND MANUFACTURING METHOD THEREFOR

(71) Applicant: POSCO, Pohang-si (KR)

(72) Inventors: Hyung Don Joo, Pohang-si (KR); Hyung Ki Park, Pohang-si (KR); Jin Wook Seo, Pohang-si (KR); Sang Woo Lee, Pohang-si (KR)

(73) Assignee: POSCO, Pohang-si (KR)

( * ) Notice: Subject to any disclaimer, the term of this patent is extended or adjusted under 35 U.S.C. 154(b) by 56 days.

This patent is subject to a terminal disclaimer.

(21) Appl. No.: 16/065,743

(22) PCT Filed: Dec. 22, 2016

(86) PCT No.: PCT/KR2016/015119
§ 371 (c)(1),
(2) Date: Jun. 22, 2018

(87) PCT Pub. No.: WO2017/111509
PCT Pub. Date: Jun. 29, 2017

(65) Prior Publication Data

US 2019/0024202 A1 Jan. 24, 2019

(30) Foreign Application Priority Data

Dec. 22, 2015 (KR) ..... 10-2015-0183796

(51) Int. Cl.
*C21D 8/12* (2006.01)
*C22C 38/02* (2006.01)
(Continued)

(52) U.S. Cl.
CPC ..... *C21D 8/1272* (2013.01); *C21D 8/1205* (2013.01); *C21D 8/1244* (2013.01);
(Continued)

(58) Field of Classification Search
None
See application file for complete search history.

(56) References Cited

U.S. PATENT DOCUMENTS

2002/0038678 A1 4/2002 Ushigami et al.
2010/0055481 A1* 3/2010 Kubo ..... C21D 8/1272 428/471
(Continued)

FOREIGN PATENT DOCUMENTS

CN 1351186 A 5/2002
CN 103525999 A 1/2014
(Continued)

OTHER PUBLICATIONS

Written Opinion and International Search Report dated Mar. 28, 2017 issued in International Patent Application No. PCT/KR2016/015119 (with English translation).
(Continued)

*Primary Examiner* — Jenny R Wu
(74) *Attorney, Agent, or Firm* — Morgan, Lewis & Bockius LLP

(57) ABSTRACT

An oriented electrical steel sheet according to an exemplary embodiment of the present invention includes Si: 2.0 to 7.0%, C: 0.005% or less (excluding 0%), Al: 0.05% or less (excluding 0%), N: 0.005% or less (excluding 0%), S: 0.005% or less (excluding 0%), a content of each of Ba and Y or a sum thereof: 0.001 to 0.3%, and Fe and other unavoidable impurities as a balance by wt %.

18 Claims, 2 Drawing Sheets

(51) Int. Cl.

| | |
|---|---|
| ***C22C 38/04*** | (2006.01) |
| ***C22C 38/06*** | (2006.01) |
| ***C22C 38/00*** | (2006.01) |
| ***C21D 9/46*** | (2006.01) |
| ***C22C 38/34*** | (2006.01) |
| ***C22C 38/60*** | (2006.01) |

(52) U.S. Cl.

CPC ..... *C21D 8/1283* (2013.01); *C21D 9/46* (2013.01); *C22C 38/00* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01); *C22C 38/34* (2013.01); *C22C 38/60* (2013.01); *C21D 8/1222* (2013.01); *C21D 8/1233* (2013.01); *C21D 8/1261* (2013.01); *C21D 2201/05* (2013.01)

(56) References Cited

U.S. PATENT DOCUMENTS

| | | | | |
|---|---|---|---|---|
| 2015/0243419 | A1 | 8/2015 | Senda et al. | |
| 2015/0340137 | A1 * | 11/2015 | Hong | C21D 8/12 148/111 |

FOREIGN PATENT DOCUMENTS

| | | | | | |
|---|---|---|---|---|---|
| CN | 104726760 | A | | 6/2015 | |
| EP | 1 179 603 | A2 | | 2/2002 | |
| EP | 2 096 185 | A1 | | 9/2009 | |
| EP | 2 940 170 | A1 | | 11/2015 | |
| JP | H01-230721 | A | | 9/1989 | |
| JP | H01-283324 | A | | 11/1989 | |
| JP | H03-002324 | A | | 1/1991 | |
| JP | H06-100937 | A | | 4/1994 | |
| JP | H10-324959 | A | | 12/1998 | |
| JP | H11-36018 | A | | 2/1999 | |
| JP | 2000-204450 | A | | 7/2000 | |
| JP | 2001-158950 | A | | 6/2001 | |
| JP | 2003-193133 | A | | 7/2003 | |
| JP | 2003193133 | A | * | 7/2003 | |
| JP | 2004-353036 | A | | 12/2004 | |
| JP | 2005-264280 | A | | 9/2005 | |
| JP | 2005264280 | A | * | 9/2005 | |
| JP | 2012-214902 | A | | 11/2012 | |
| JP | 2014-095129 | A | | 5/2014 | |
| KR | 10-1992-0014941 | A | | 8/1992 | |
| KR | 10-1997-0043184 | A | | 7/1997 | |
| KR | 10-1999-0047107 | A | | 7/1999 | |
| KR | 10-2002-0044243 | A | | 6/2002 | |
| KR | 10-0336661 | B1 | | 7/2002 | |
| KR | 10-0721822 | B1 | | 5/2007 | |
| KR | 10-2008-0010439 | A | | 1/2008 | |
| KR | 10-2009-0049611 | A | | 5/2009 | |
| KR | 10-2014-0127648 | A | | 11/2014 | |
| KR | 10-2015-0073551 | A | | 7/2015 | |
| KR | 10-2016-0072704 | A | | 6/2016 | |
| WO | 2014/104444 | A1 | | 7/2014 | |
| WO | WO-2014104444 | A1 | * | 7/2014 | C22C 38/06 |

OTHER PUBLICATIONS

Extended European Search Report issued in corresponding European Patent Application No. 16879376.8 dated Nov. 23, 2018.

Chinese Office Action dated Aug. 20, 2019 issued in Chinese Patent Application No. 201680076953.3.

Basis of Engineering Material, Sep. 30, 2007.

Indian Office Action dated Sep. 3, 2020 issued in Indian Patent Application No. 201827026884.

Korean Office Action dated Jul. 29, 2020 issued in Korean Patent Application No. 10-2015-0183796.

Korean Office Action dated Oct. 20, 2020 issued in Korean Patent Application No. 10-2015-0183796.

* cited by examiner

GRAIN-ORIENTED ELECTRICAL STEEL SHEET AND MANUFACTURING METHOD THEREFOR

CROSS REFERENCE

This patent application is the U.S. National Phase under 35 U.S.C. § 371 of International Application No. PCT/KR2016/015119, filed on Dec. 22, 2016, which claims the benefit of Korean Patent Application No. 10-2015-0183796, filed on Dec. 22, 2015, the entire contents of each are hereby incorporated by reference.

TECHNICAL FIELD

An oriented electrical steel sheet and a manufacturing method thereof are provided.

BACKGROUND ART

Generally, in a grain-oriented electrical steel sheet having an excellent magnetic characteristic, a Goss texture of a {110}<001> orientation should strongly develop in a rolling direction thereof, and in order to form such a Goss texture, abnormal grain growth corresponding to secondary recrystallization must be formed.

The abnormal grain growth occurs when normally growing grain boundaries are inhibited by precipitates, inclusions, or elements that are solid-dissolved or segregated, unlike the normal grain growth.

The oriented electrical steel sheet is manufactured using a method mainly using precipitates such as AlN, MnS, and the like as a grain growth inhibitor to secure secondary recrystallization. A manufacturing method of the oriented electrical steel sheet using AlN and MnS precipitates as a grain growth inhibitor has problems as stated below.

In order to use AlN and MnS precipitates as the grain growth inhibitor, the precipitates must be distributed to the steel sheet very finely and uniformly.

In order to distribute fine precipitates uniformly in this way, coarse precipitates that existed in the steel are solidified by heating the slab for a long time at high temperature of 1300° C. or more, and then the hot rolling must be performed at a very high speed so as to terminate the hot rolling in a state in which precipitation does not occur.

For this, there are problems in which a slab heating facility of a large size is required, in order to suppress precipitation to the utmost, the hot rolling and a spiral-wound process must be very carefully managed, and the precipitates solidified in a hot rolled sheet annealing process after the hot rolling must be managed to be finely precipitated.

Also, if the slab is heated to a high temperature, as $Fe_2SiO_4$ having a low melting point is formed, a slab washing phenomenon is generated, thereby deteriorating a real yield.

In addition, to remove constituent components of the precipitates after secondary recrystallization is completed, since it is necessary to perform purification annealing for 30 hours or more at a high temperature of 1200° C., there is a problem with complexity in the manufacturing process and a cost burden.

Further, in the purification annealing process, as the AlN-based precipitates are decomposed with Al and N, and then Al moves to the steel sheet surface and is reacted with oxygen of a surface oxidation layer, $Al_2O_3$ is formed.

The Al-based oxide thus formed and AlN precipitates that are not decomposed in the purification annealing process prevent movement of magnetic domains in the steel sheet or near the surface, thereby being a cause of deteriorating iron loss.

DISCLOSURE

Technical Problem

An exemplary embodiment of the present invention provides an oriented electrical steel sheet.

Technical Solution

Another exemplary embodiment of the present invention provides a manufacturing method of the oriented electrical steel sheet.

An oriented electrical steel sheet according to an exemplary embodiment of the present invention includes Si: 2.0 to 7.0%, C: 0.005% or less (excluding 0%), Al: 0.05% or less (excluding 0%), N: 0.005% or less (excluding 0%), S: 0.005% or less (excluding 0%), a content of each of Ba and Y or a sum thereof: 0.001 to 0.3%, and Fe and other unavoidable impurities as a balance by wt %.

Mn at 0.005 to 0.5 wt % may be further included.

P at 0.005 to 0.075 wt % may be further included.

Cr at 0.005 to 0.35 wt % may be further included.

Sb and Sn at 0.005 to 0.2 wt % as a content of each or a sum thereof may be further included.

An area ratio of a grain having a size of 1 mm or less among the grain existing in the electrical steel sheet may be 10% or less.

An angle difference between a <100> surface and a sheet surface of the steel sheet in the electrical steel sheet may be 3.5° or less.

Ba and Y segregated on a grain boundary or a combination thereof may be further included.

An oriented electrical steel sheet according to an exemplary embodiment of the present invention includes a coated steel sheet and a coating layer, wherein the coated steel sheet includes Si: 2.0 to 7.0%, C: 0.005% or less (excluding 0%), Al: 0.05% or less (excluding 0%), N: 0.005% or less (excluding 0%), S: 0.005% or less (excluding 0%), a content of each of Ba and Y or a sum thereof: 0.001 to 0.3%, and Fe and other unavoidable impurities as a balance by wt %, and in an entire component including the coated steel sheet and the coating layer, Al at 0.001 to 0.1 wt % and Mn at 0.005 to 0.9 wt % are included.

The coated steel sheet may further include Mn at 0.005 to 0.5 wt %.

The coated steel sheet may further include P at 0.005 to 0.075 wt %.

The coated steel sheet may further include Cr at 0.005 to 0.35 wt %.

The coated steel sheet may further include Sb and Sn at 0.005 to 0.2 wt % as a content of each or a sum thereof.

An area ratio of a grain having a size of 1 mm or less among the grain existing in the coated steel sheet may be 10% or less.

An angle difference between a <100> surface and a sheet surface in the electrical steel sheet may be 3.5° or less.

Ba and Y segregated on a grain boundary or a combination thereof may be further included.

A manufacturing method of an oriented electrical steel sheet includes: a step of heating a slab including Si: 2.0 to 7.0%, C: 0.001 to 0.1%, Al: 0.05% or less (excluding 0%), Ba and Y of 0.001 to 0.3% as a content of each or a sum thereof, and Fe and other unavoidable impurities as a balance by wt %; a step of hot rolling the slab to manufacture a hot rolled sheet; a of step cold-rolling the hot rolled sheet to manufacture a cold rolled sheet; a step of primary recrystallization-annealing the cold rolled sheet; and a step of secondary recrystallization-annealing the electrical steel sheet in which the primary recrystallization annealing is completed.

The slab may include Al at 0.005 wt % or less (excluding 0%).

The slab may further include N at 0.03 wt % or less (excluding 0%) and S at 0.03 wt % or less (excluding 0%).

The slab may further include Mn at 0.005 to 0.5 wt %.

The slab may further include P at 0.005 to 0.075 wt %.

The slab may further include Cr at 0.005 to 0.35 wt %.

The slab may further include Sb and Sn at 0.005 to 0.2 wt % as a content of each or a sum thereof.

In the step of heating the slab, the slab may be heated to 1040 to 1280° C.

After the step of hot rolling, a step of performing hot rolled sheet annealing may be further included.

The primary recrystallization annealing may maintain the cold rolled sheet at a temperature of 750° C. or more for 30 seconds or more.

A soaking temperature of the secondary recrystallization annealing may be 900° C. to 1250° C.

A nitriding step may be further included after the step of manufacturing the cold rolled sheet and before the step of secondary recrystallization annealing, and after the nitriding step, the steel sheet may include N at 140 to 500 ppm.

After the step of secondary recrystallization annealing, the steel sheet may include N at 50 ppm or less.

Advantageous Effects

In the oriented electrical steel sheet according to an exemplary embodiment of the present invention, the Goss grain is formed stably such that the iron loss is low and the magnetic characteristic is excellent.

Also, AlN and MnS are not used as the grain growth inhibitor such that high temperature slab reheating at 1300° C. or more is not required.

Further, purification annealing at a high temperature to remove precipitates such as AlN and MnS is not necessary such that a manufacturing cost is reduced.

In addition, since it is not necessary to remove N, S, and the like after high temperature annealing, a surface defect due to a gasifying reaction of N or S does not exist in the purification annealing process.

MODE FOR INVENTION

Figure 1:
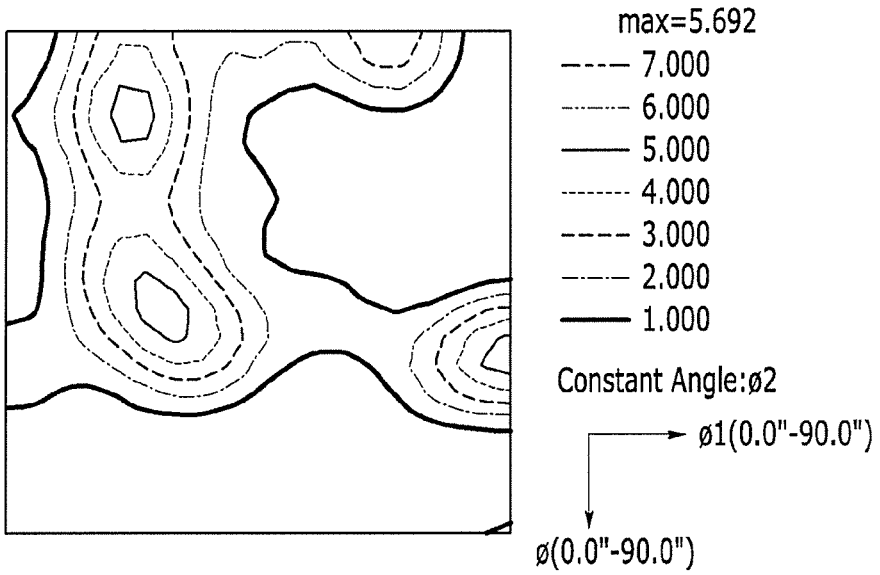
FIG. 1 is a view showing an orientation distribution function (ODF) (Ψ2=45°) after measuring a non-oriented electrical steel sheet according to Comparative Material 1 by EBSD.

The terms first, second, third, and the like are used to describe various portions, components, regions, layers, and/or sections, but the present invention is not limited thereto. These terms are used only to distinguish any portion, component, region, layer, or section from other portions, components, regions, layers, or sections. Therefore, a first portion, component, region, layer, or section to be described below may be referred to as a second portion, component, region, layer, or section without departing from the scope of the present invention.

The technical terms used herein are used merely for the purpose of describing a specific exemplary embodiment, and are not intended to limit the present invention. Singular expressions used herein include plural expressions unless they have definitely opposite meanings. The terms "comprises" and/or "comprising" used in the specification specify particular features, regions, integers, steps, operations, elements, components, but do not preclude the presence or addition of other features, regions, integers, steps, operations, elements, and/or components thereof.

It will be understood that when an element such as a layer, film, region, or substrate is referred to as being "on" another element, it can be directly on the other element or intervening elements may also be present. In contrast, when an element is referred to as being "directly on" another element, there are no intervening elements present.

Although not defined otherwise, all terms including technical terms and scientific terms used in this specification have the same meanings as those commonly understood by a person having ordinary skill in the art to which the present invention pertains. Terms defined in a common dictionary are construed as having meanings that comply with related technical documents and disclosed contents, and are not to be construed as having idealized or very official meanings unless defined otherwise.

Unless particularly mentioned, % refers to wt %, and 1 ppm is 0.0001 wt %.

Hereinafter, exemplary embodiments of the present invention will be described in detail so as to be easily practiced by a person skilled in the art to which the present invention pertains. As those skilled in the art would realize, the described embodiments may be modified in various different ways, all without departing from the spirit or scope of the present invention.

An oriented electrical steel sheet according to an exemplary embodiment of the present invention includes Si: 2.0 to 7.0%, C: 0.005% or less (excluding 0%), Al: 0.05% or less (excluding 0%), N: 0.005 to 0.05%, S: 0.005% or less (excluding 0%), each of Ba and Y or a sum content thereof: 0.001 to 0.3%, and Fe and other unavoidable impurities as a balance by wt %.

First, reasons for component limitations of the oriented electrical steel sheet are described.

Barium (Ba) and yttrium (Y) act as grain growth inhibitors, thereby suppressing grains of orientations other than Goss grain at the time of secondary recrystallization annealing to improve magnetism of an electrical steel sheet. Ba and Y may be added respectively or may be added in combination, and each or a sum content thereof of Ba and Y may be from 0.001 to 0.3 wt %. If the content of Ba and Y are very low, it is difficult to exert an adequate suppressive power, and if they are too high, brittleness of the steel sheet increases, so cracks at the time of rolling may occur. The content of Ba and Y means a content of Ba or Y when Ba and Y are independently added, and it means a sum (Ba+Y) of the contents of Ba and Y when Ba and Y are added as the composite.

Silicon (Si) is a basic composition of the electric steel sheet, and serves to increase specific resistance of a material to lower core loss, that is, iron loss. Si may be included at 2.0 to 7.0 wt %. When the Si content is too small, the specific resistance decreases and then the loss characteristic deteriorates, and when the Si content is excessive, the brittleness of the steel becomes high so the cold-rolling may become difficult. It does not exceed the range of the present invention even if it is manufactured by a diffusion method after a powder application or a surface deposition. In detail, Si may be included at 2.0 to 4.5 wt %.

Carbon (C) as an austenite stabilizing element may be included at 0.005 to 0.1 wt % in a slab in the manufacturing process. Thereby, a coarse columnar structure generated in a casting process may be refines and slab center segregation of S may be suppressed. Also, as hardening of the steel sheet is promoted during the cold-rolling, secondary recrystallization nuclei production of a {110}<001> orientation in the steel sheet may be promoted. If too much C is contained in the slab, an edge crack may occur during the hot rolling. Decarbonizing annealing is performed in the manufacturing process, and the content of C in the final electrical steel sheet manufactured after the decarbonizing annealing may be 0.005 wt % or less. In detail, it may be 0.003 wt % or less.

In the present invention, since AlN may not be used as the grain growth inhibitor, the content of aluminum (Al) may be actively suppressed. Also, AlN may be simultaneously used. Therefore, Al may be contained or may not be added. Even if Ba and Y are simultaneously used with the precipitates, the iron loss may be further improved. Thus, in an exemplary embodiment of the present invention, Ba and Y replace the AlN grain growth inhibitor or act as the grain growth inhibitor along with AlN.

When using the Al inhibitor, Al is contained at 0.05 wt % or less. More preferably, Al is included at 0.01 wt % or more and 0.04 wt % or less. If necessary, since Al may not be used, in this case, Al may be contained at 0.005 wt % or less to be hardly added.

Since nitrogen (N) forms precipitates such as AlN, (Al, Mn)N, (Al, Si, Mn)N, $Si_3N_4$, and the like, in the manufacturing method of the present invention, it may be contained at 0.03 wt % in the slab, however it is almost all removed in a production sheet. In more detail, it may be included at 0.01 wt % in the slab, and the most preferable content may be 0.005 wt % or less. When the N content is low, there is an effect that an initial grain size before the cold-rolling becomes coarse, and a number of grains having the {110}<001> orientation increases in primary recrystallization such that the size of the secondary recrystallization grain decreases, thereby improving the magnetism of the final product. In the production sheet, nitrogen may be removed to be included at 0.005 wt % or less.

In the electrical steel sheet manufacturing process, a nitriding process may be added before the secondary recrystallization step that is described later, and after a nitriding step, the steel sheet may include N at 140 to 500 ppm. However, in the secondary recrystallization annealing step, nitrogen is removed, and after the secondary recrystallization annealing step, the steel sheet may include N at 50 ppm or less.

Sulfur (S) may not be added in an exemplary embodiment of the present invention or may be controlled to 0.005 wt % or less, because sulfur (S) is an element of which a solidification temperature is high at the time of the hot rolling and sulfur (S) segregation is severe. In the manufacturing method, it may be contained in the slab at 0.03% or less, or is almost all removed in the production sheet. In the slab, a further preferably content is 0.01 wt % or less, and 0.005 wt % or less is best. However, this may be selectable in an aspect of the primary recrystallization grain control. In detail, it may be 0.005 wt % or less in the production sheet. More preferably, it may be 0.0015 wt % or less.

Manganese (Mn) as a specific resistance element has an effect of improving the magnetism, however if it is excessively contained, a phase transformation is caused after the secondary recrystallization and it affects the magnetism, and when including manganese, the content of Mn is limited to 0.005 to 0.5 wt %.

Since phosphorous (P) promotes the growth of the primary recrystallization grain in the oriented electrical steel sheet of a low temperature heating type, the secondary recrystallization temperature increases, thereby increasing the integration of the {110}<001> orientation in the final product. Meanwhile, P increases the number of crystal grains having the {110}<001> orientation in the primary recrystallized steel sheet to lower iron loss in the final product, and also strongly develops a {111}<112> aggregation texture in the primary recrystallized sheet to improve the {110}<001> integration in the final product, thereby increasing magnetic flux density. Further, P has a function of enhancing a suppression force by being segregated in a grain boundary up to a high temperature of about 1000° C. to delay decomposition of precipitates, during secondary recrystallization annealing. When including P in the electrical steel sheet, it may be present at 0.005 to 0.075 wt %. 0.005 wt % or more is necessary for the above-mentioned action to be normally exhibited. However, if P is excessively included, the size of primary recrystallized grains is rather decreased, so the secondary recrystallization is unstable, and also the brittleness is increased to hinder the cold rolling.

Chromium (Cr) as a ferrite expansion element has an action of growing the primary recrystallization grain and increases the grain of the {110}<001> orientation in the primary recrystallization sheet. When including Cr, it may be present at 0.005 to 0.35 wt % in the electrical steel sheet. 0.005 wt % or more is necessary for the above-mentioned action to be normally exhibited. If chromium is excessively included, in the simultaneous decarburization and nitride process, a dense oxidation layer is formed on the surface part of the steel sheet, thereby interfering with the nitriding. More preferably, Cr may be included at 0.03 to 0.2 wt %.

Antimony (Sb) and tin (Sn) as low temperature segregation elements have a function of assisting the precipitates. Sb and Sn may be further included at each or the sum content thereof of 0.005 to 0.2 wt %. Sb and Sn affect the integration degree improvement such that each or the sum content thereof of 0.005 wt % or more may be included. However, upon excessive addition, the decarburization is disturbed such that it is limited to 0.2 wt % or less. In detail, Sb and Sn may be further included, and Sb at 0.01 to 0.06 wt % and Sn at 0.02 to 0.1 wt % may be further included.

Components such as titanium (Ti), magnesium (Mg), calcium (Ca), and the like react with oxygen in the steel and then oxides are formed, and accordingly they are preferably not contained. However, considering the impurities in the steel, they can be controlled to 0.005% or less, respectively.

Also, in the electrical steel sheet, an area ratio of the grain having a particle diameter of 1 mm or less may be 10% or less for an entire grain area of 100%. When the area ratio of the grain having the particle diameter of 1 mm or less exceeds 10% or less for the entire grain area of 100%, the not enough grain is grown, so the magnetism may be deteriorated.

Also, in the electrical steel sheet, an angle difference between a <100> surface and a sheet surface of the steel sheet may be 3.5° or less. Here, the sheet surface of the steel sheet means an XY surface when a rolling direction of the steel sheet is referred to as an X axis and a width direction is referred to as a Y axis. When the angle difference exceeds 3.5°, the magnetism of the steel sheet may be deteriorated.

Also, an element of Ba or Y or combinations thereof acts as an inhibitor such that it may be segregated on the grain boundary.

The oriented electrical steel sheet according to an exemplary embodiment of the present invention includes a coated steel sheet and a coating layer, wherein the coated steel sheet includes Si: 2.0 to 7.0%, C: 0.005% or less (excluding 0%), Al: 0.05% or less (excluding 0%), N: 0.005% or less (excluding 0%), each of Ba and Y or a sum content thereof: 0.001 to 0.3% by wt %, and Fe and other unavoidable impurities as a balance, and in the entire components including the coated steel sheet and the coating layer, Al at 0.001 to 0.1 wt % and Mn at 0.005 to 0.9 wt % are contained.

The description of the coated steel sheet is the same as the description of the above-described oriented electrical steel sheet such that repeated description is omitted. The coating layer is formed on the coated steel sheet. The composition of the coating layer is similar to the composition of the coated is steel sheet, however Al and Mn are included at more than in the coated steel sheet. Accordingly, in the entire components including the coated steel sheet and the coating layer, Al at 0.001 to 0.1 wt % and Mn at 0.005 to 0.9 wt % are included.

A manufacturing method of an oriented electrical steel sheet according to an exemplary embodiment of the present invention includes: a step of heating a slab including Si: 2.0 to 7.0%, C: 0.001 to 0.1%, Mn: 0.005 to 0.5%, Ba and Y of each or a sum content thereof: 0.001 to 0.3%, and Fe and other unavoidable impurities as a balance; a step of hot rolling the slab to manufacture a hot rolled sheet; a step of cold-rolling the hot rolled sheet to manufacture a cold rolled sheet; a step of primary recrystallization-annealing the cold rolled sheet; and a step of secondary recrystallization-annealing the electrical steel sheet to which the primary recrystallization annealing is completed.

In the slab, Al may be included at 0.05 wt % or less, or may be controlled at 0.005 wt % or less as an extremely low amount.

The slab may further include N at 0.03 wt % or less and S at 0.03 wt % or less. More preferably, the slab may include N at 0.005 wt % or less and S at 0.005 wt % or less.

First, the slab is heated. The description for the composition of the slab is the same as for the composition of the above-described electrical steel sheet such that the repeated description is omitted. A heating temperature of the slab is not limited, but if the slab is heated at a temperature of 1280° C. or less, a columnar crystal structure of the slab is prevented from being coarsely grown such that a crack of the sheet may be prevented in the hot rolling process. Accordingly, the heating temperature of the slab may be 1000° C. or more and 1280° C. or less.

When the heating of the slab is completed, the hot rolling is performed. The hot rolling temperature or the cooling temperature are not limited, but as an exemplary embodiment, the hot rolling is finished at 950° C. or less and the slab may be cooled and spiral-wound at 600° C. or less. A hot rolled sheet of a 1.5 to 4.0 mm thickness may be manufactured by the hot rolling.

For the hot-rolled sheet, if necessary, the hot rolled sheet annealing may be performed, or cold-rolling may be performed without the hot rolled sheet annealing. In the case of performing the hot-rolled sheet annealing, the hot-rolled structure is heated to a temperature of 900° C. or more to make it uniform, then it is soaked and cooled.

The cold-rolling uses a reverse roller or a tandem roller and the cold rolled sheet having a thickness of 0.1 to 0.5 mm may be manufactured by one cold-rolling, a plurality of cold-rollings, or a plurality of cold-rolling methods including intermediate annealing. In detail, the cold rolled sheet of a thickness of 0.15 to 0.35 mm may be manufactured.

The steel sheet, when the cold-rolling is completed, is primary recrystallization-annealed. In the primary recrystallization annealing, decarburization and primary recrystallization in which a nucleus of the Goss grain is produced are performed.

The primary recrystallization annealing may maintain the cold rolled sheet at the temperature of 750° C. or more for 30 or more seconds. In the case of less than 750° C., sufficient energy for the grain growth may not be provided, while in the case of less than 30 seconds, the grain growth is not sufficient such that the magnetism may be deteriorated.

Also, in the manufacturing method of the oriented electrical steel sheet according to an exemplary embodiment of the present invention, the nitride annealing process after the decarbonizing annealing may be omitted. In the conventional manufacturing method of the oriented electrical steel sheet using AlN as the grain growth inhibitor, the nitride annealing is required for the formation of AlN. However, in the manufacturing method of the oriented electrical steel sheet according to an exemplary embodiment of the present invention, the AlN is not used as the grain growth inhibitor such that the nitride annealing process is not required.

An annealing separation agent including MgO is coated on the steel sheet of which the primary recrystallization annealing is completed, and the secondary recrystallization annealing is performed. At the time of the secondary recrystallization annealing, the soaking temperature may be from 900° C. to 1250° C. In the case less than 900° C., the Goss grain is not sufficiently grown such that the magnetism may be deteriorated, while in the case of exceeding 1250° C., the grain is coarsely grown such that the characteristics of the electrical steel sheet may be deteriorated.

After the step of manufacturing the cold rolled sheet, a nitriding step is further included before the step of the secondary recrystallization annealing, and after the nitriding step, the cold rolled sheet may include N at 50 to 500 ppm. In detail, 140 to 500 ppm of N may be included.

In the manufacturing method of the oriented electrical steel sheet according to an exemplary embodiment of the present invention, a purification annealing process after completing the secondary recrystallization annealing may be omitted. After the secondary recrystallization annealing, the steel sheet may include N at 50 ppm or less.

In the conventional manufacturing method of the oriented electrical steel sheet using MnS and AlN as the grain growth inhibitor, the purification annealing at a high temperature to remove the precipitates such as AlN, MnS, and the like is required, however the purification annealing process may not be required in the manufacturing method of the oriented electrical steel sheet according to an exemplary embodiment of the present invention.

Hereinafter, the present invention is described in detail through examples. However, these examples are meant to illustrate the present invention and the present invention is not limited thereto.

Example 1

A slab including Si: 3.21%, C: 0.055%, Mn: 0.10%, Al: 0.029%, N: 0.0048%, S: 0.0045%, and Fe and other unavoidable impurities as the balance as wt % by changing the contents of barium (Ba) and yttrium (Y) as in Table 1 is heated to a temperature of 1150° C. for 210 minutes and is hot-rolled to manufacture the hot rolled sheet with a 2.6 mm thickness. The hot rolled sheet is heated to 1090° C., maintained at 920° C. for 90 seconds, rapidly cooled in water, and acid-cleansed, and then cold-rolled to a 0.262 mm thickness. For the cold-rolled sheet, a mixed atmosphere of hydrogen at 75% and nitrogen at 25% with a dew point temperature of 65° C., and dry ammonia gas at 1% are simultaneously injected in a furnace that is maintained at 865° C. and are maintained for 150 seconds for simultaneously decarburizing and nitriding. Carbon is present at 30 ppm or less and nitrogen is present at 190 ppm.

MgO as an annealing separation agent is coated on the steel sheet and is finally annealed in a coiled state. In the final annealing, a primary soaking temperature is 700° C., a secondary soaking temperature is 1200° C., and a temperature raising condition of a temperature raising period is 15° C. per hour in the temperature range of 700 to 1200° C. On the other hand, a soaking time at 1200° C. is 15 hours. An atmosphere upon final annealing is a mixed atmosphere of 25% nitrogen+75% hydrogen up to 1200° C., and after arriving at 1200° C., a 100% hydrogen atmosphere is maintained and the furnace is cooled. In this case, in the production sheet, for a metal layer except for the coating layer, an Al content is 0.001% and an N content is 8 ppm. A magnetic characteristic measured for each condition is summarized in Table 1 below.

TABLE 1

| Ba content (wt %) | Y content (wt %) | Magnetic flux density (B10, Tesla) | Division |
|---|---|---|---|
| 0 | 0 | 1.90 | Comparative Material 1 |
| 0.01 | 0 | 1.93 | Inventive Material 1 |
| 0.02 | 0 | 1.95 | Inventive Material 2 |
| 0.04 | 0 | 1.97 | Inventive Material 3 |
| 0.08 | 0 | 1.95 | Inventive Material 4 |
| 0.15 | 0 | 1.93 | Inventive Material 5 |
| 0.4 | 0 | rolling crack occur | Comparative Material 2 |
| 0 | 0.011 | 1.93 | Inventive Material 6 |
| 0 | 0.025 | 1.95 | Inventive Material 7 |
| 0 | 0.04 | 1.97 | Inventive Material 8 |
| 0 | 0.07 | 1.95 | Inventive Material 9 |
| 0 | 0.12 | 1.94 | Inventive Material 10 |
| 0 | 0.38 | rolling crack occur | Comparative Material 3 |
| 0.023 | 0.02 | 1.97 | Inventive Material 11 |
| 0.05 | 0.048 | 1.95 | Inventive Material 12 |
| 0.35 | 0.35 | rolling crack occur | Comparative Material 4 |

As shown in Table 1, it may be confirmed that magnetism is far superior in the Inventive Material 1 to the Inventive Material 12, including an appropriate amount of Ba and Y, compared with a Comparative Material 1 to a Comparative Material 4.

Figure 2:
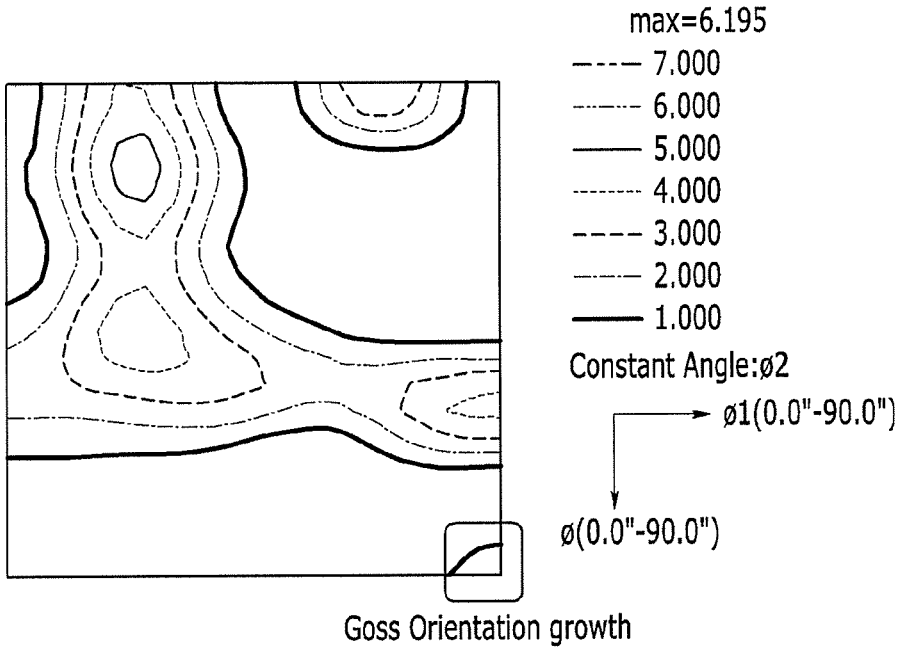
FIG. 2 is a view showing an orientation distribution function (ODF)) (Ψ2=45°) after measuring a non-oriented electrical steel sheet according to Inventive Material 8 by EBSD.

Also, the non-oriented electrical steel sheet according to the Comparative Material 1 and the Inventive Material 8 is measured by the EBSD, and views showing an orientation distribution function (ODF) are shown in FIG. 1 and FIG. 2.

For the non-oriented electrical steel sheet according to the Inventive Material 8, an exact Goss orientation ratio (≤10°) is markedly increased as 0.72 volume % compared with the exact Goss orientation ratio (≤10°) of 0.28 volume % of the non-oriented electrical steel sheet according to the Comparative Material 1. For the non-oriented electrical steel sheet according to the Inventive Material 8, a Goss orientation ratio (≤15°) is also markedly increased as 1.62 volume % compared with the Goss orientation ratio (≤15°) of 1.04 volume % of the non-oriented electrical steel sheet according to the Comparative Material 1. On the other hand, for the non-oriented electrical steel sheet according to the Inventive Material 8, a {111}<112> (≤15°) ratio as 12.8 volume % may be partially decreased compared with the {111}<112> (≤15°) ratio of the non-oriented electrical steel sheet according to the Comparative Material 1 as 13.8 volume %, and the {411}<148> (≤15°) ratio of the non-oriented electrical steel sheet according to the Inventive Material 8 as 30.2 volume % is partially increased compared with the {411}<148> (≤15°) ratio of the non-oriented electrical steel sheet according to the Comparative Material 1 as 28.6 volume %.

Example 2

The slab including Si: 3.21%, C: 0.056%, Mn: 0.102%, Al: 0.025%; N: 0.0054% S: 0.0044%, Ba: 0.021%, and Y: 0.022% as wt %, and Fe and other unavoidable impurities as the balance by changing the contents of Sn, Sb, P, Cr a in Table 2 below, is heated to a 1150° C. temperature for 90 minutes, is hot-rolled, rapidly cooled to 580° C., and annealed for one hour at 580° C., then furnace-cooled and hot-rolled to manufactured the hot rolled sheet of the 2.6 mm thickness. The hot rolled sheet is heated to the temperature of to 1050° C. or more, maintained at 910° C. for 90 seconds, rapidly cooled in boiling water, and acid-cleansed. Next, the cold rolling is performed to the 0.262 mm thickness. The cold-rolled steel sheet is subjected to the raising temperature for 120 seconds at a temperature of 800 to 900° C. Next, the steel sheet is maintained in the mixed atmosphere of the dew point temperature of 60° C., which is formed by simultaneously injecting 50% hydrogen and 50% nitrogen, for the decarburization process, and carbon is present at 30 ppm or less.

The steel sheet is coated with MgO as the annealing separation agent and then is finally annealed in the coiled state. For the final annealing, the atmosphere in the temperature raising to 1200° C. is the mixed atmosphere of 25% nitrogen+75% hydrogen, and the 100% hydrogen atmosphere is maintained after reaching 1200° C. for 20 hours or more and then furnace-cooled. For each condition, the magnetic characteristic measured at the decarburization temperature representing the best magnetism in the final product is summarized in Table 2 below.

TABLE 2

| Sn content (wt %) | Sb content (wt %) | P content (wt %) | Cr content (wt %) | Magnetic flux density (B10, Tesla) | Division |
|---|---|---|---|---|---|
| 0 | 0 | 0 | 0 | 1.95 | Inventive Material 13 |
| 0.04 | 0 | 0 | 0 | 1.965 | Inventive |

TABLE 2-continued

| Sn content (wt %) | Sb content (wt %) | P content (wt %) | Cr content (wt %) | Magnetic flux density (B10, Tesla) | Division |
|---|---|---|---|---|---|
| | | | | | Material 14 |
| 0.06 | 0 | 0 | 0 | 1.961 | Inventive Material 15 |
| 0.21 | 0 | 0 | 0 | decarburization defect | Comparative Material 5 |
| 0 | 0.025 | 0 | 0 | 1.96 | Inventive Material 16 |
| 0 | 0.22 | 0 | 0 | decarburization defect and rolling defect | Comparative Material 6 |
| 0 | 0 | 0.038 | 0 | 1.963 | Inventive Material 17 |
| 0 | 0 | 0.1 | 0 | rolling crack | Comparative Material 7 |
| 0 | 0 | 0 | 0.1 | 1.963 | Inventive Material 18 |
| 0 | 0 | 0 | 0.4 | decarburization defect | Comparative Material 8 |
| 0.05 | 0.027 | 0.035 | 0 | 1.972 | Inventive Material 19 |

In Table 2, when including P, Cr, Sb, and Sn, the magnetism is improved, however when being included excessively, the decarburization or the rolling property is deteriorated.

DESCRIPTION OF SYMBOLS

Although exemplary embodiments of the present invention were described above, those skilled in the art would understand that the present invention may be implemented in various ways without changing the spirit or necessary features. Therefore, the embodiments described above are only examples and should not be construed as being limitative in any respects.

The invention claimed is:

1. An oriented electrical steel sheet including Si: 2.0 to 7.0%, C: 0.005% or less, excluding 0%, Al: 0.05% or less, excluding 0%, N: 0.005% or less, excluding 0%, S: 0.005% or less, excluding 0%, a content of a sum of Ba and Y: 0.001 to 0.3%, and Fe and other unavoidable impurities as a balance by wt % as a composition of the oriented electrical steel sheet, wherein the oriented electrical steel sheet composition further includes Ba: 0.001% to 0.3% by wt %.

2. The oriented electrical steel sheet of claim 1, further comprising Mn at 0.005 to 0.5 wt %.

3. The oriented electrical steel sheet of claim 1, further comprising P at 0.005 to 0.075 wt %.

4. The oriented electrical steel sheet of claim 1, further comprising Cr at 0.005 to 0.35 wt %.

5. The oriented electrical steel sheet of claim 1, further comprising Sb and Sn at 0.005 to 0.2 wt % as a content of each or a sum thereof.

6. The oriented electrical steel sheet of claim 1, wherein an area ratio of a grain having a size of 1 mm or less among the grain existing in the electrical steel sheet is 10% or less.

7. The oriented electrical steel sheet of claim 1, wherein an angle difference between a <100> surface and a sheet surface of the steel sheet in the electrical steel sheet is 3.5° or less.

8. The oriented electrical steel sheet of claim 1, further comprising Ba and Y segregated on a grain boundary, or a combination thereof.

9. A manufacturing method of an oriented electrical steel sheet, comprising:

a step of heating a slab including Si: 2.0 to 7.0%, C: 0.001 to 0.1%, Al: 0.05% or less (excluding 0%), a content of a sum of Ba and Y: 0.001 to 0.3%; and Fe and other unavoidable impurities as a balance, by wt %, wherein the slab includes Ba: 0.001% to 0.3% by wt %;

a step of hot rolling the slab to manufacture a hot rolled sheet; a step of cold-rolling the hot roped sheet to manufacture a cold roiled sheet; a step of primary recrystallization-annealing the cold roiled sheet; and a step of secondary recrystallization-annealing the electrical steel sheet of which the primary recrystallization annealing is completed thus forming the oriented electrical steel sheet of claim 1.

10. The manufacturing method of claim 9, wherein the slab includes Al at 0.005 wt % or less (excluding 0%).

11. The manufacturing method of claim 9, wherein the slab further includes N at 0.03 wt % or less (excluding 0%) and S at 0.03 wt % or less (excluding 0%).

12. The manufacturing method of claim 9, wherein the slab further includes Mn at 0.005 to 0.5 wt %.

13. The manufacturing method of claim 9, wherein, in the step of heating the slab, the slab is heated to 1040 to 1280° C.

14. The manufacturing method of claim 9, further comprising, after the step of hot rolling, a step of performing hot rolled sheet annealing.

15. The manufacturing method of claim 9, wherein the primary recrystallization annealing maintains the cold rolled sheet at a temperature of 750° C. or more for 30 seconds or more.

16. The manufacturing method of claim 9, wherein a soaking temperature of the secondary recrystallization annealing is 900° C. to 1250° C.

17. The manufacturing method of claim 9, wherein a nitriding step after the step of manufacturing the cold rolled sheet and before the step of the secondary recrystallization annealing, and after the nitriding step, the steel sheet includes N at 140 to 500 ppm.

18. The manufacturing method of claim 9, wherein after the step of secondary recrystallization annealing, the steel sheet includes N at 50 ppm or less.

* * * * *